US006308426B1

(12) United States Patent
Lim

(10) Patent No.: US 6,308,426 B1
(45) Date of Patent: Oct. 30, 2001

(54) ELLIPSOGRAPH

(76) Inventor: Hyoun-Gyu Lim, Daechi Hyundai - Apartment 101-104, 974 Daechi-dong, Kangnam-ku, Seoul (KR), 135-280

( * ) Notice: Subject to any disclaimer, the term of this patent is extended or adjusted under 35 U.S.C. 154(b) by 0 days.

(21) Appl. No.: 09/447,636

(22) Filed: Nov. 23, 1999

(30) Foreign Application Priority Data

Nov. 26, 1998 (KR) ..... 98-50950

(51) Int. Cl.[7] ..... B43L 11/045
(52) U.S. Cl. ..... 33/30.5; 33/30.1
(58) Field of Search ..... 33/30.1, 27.01, 33/30.5, 30.6

(56) References Cited

U.S. PATENT DOCUMENTS 1,724,738 * 8/1929 Stossel ..... 33/30.5
2,831,251 * 4/1958 Barker ..... 33/30.5

FOREIGN PATENT DOCUMENTS 811120 9/1981 (KR) .
906967 8/1990 (KR) .

* cited by examiner

*Primary Examiner*—Christopher W. Fulton
(74) *Attorney, Agent, or Firm*—Richard M. Goldberg

(57) ABSTRACT

Disclosed is an ellipsograph for drawing an ellipse. A base member for defining one side, that is, a base of a triangle, is provided and fixed to a plane of a drawing sheet. A centering section and an ellipse drawing frame are installed at a middle of the base member. An ellipse deriving thread for determining the total length of three sides of the triangle which is used to draw the ellipse is prepared and supported by both ends of the base member and one end of the ellipse drawing frame thereby to form the triangle. The ellipse is drawn by the ellipse drawing frame while the ellipse drawing frame is rotated and linearly reciprocated due to the fact that the ellipse drawing frame is pressed by the ellipse deriving thread against elastic force of elastic spring and biased by the elastic spring against tension of the ellipse deriving thread.

17 Claims, 5 Drawing Sheets

ELLIPSOGRAPH

BACKGROUND OF THE INVENTION

1. Field of the Invention

The present invention relates to an ellipsograph for drawing an ellipse, and more particularly, the present invention relates to an ellipsograph which has a simple structure and includes a base member for defining a fixed base of a triangle and an ellipse drawing frame and an ellipse deriving thread for cooperatively enabling an elliptic locus to be drawn through the movement of a vertex of the triangle, whereby an ellipse having a variety of sizes can be conveniently drawn on the basis of a fundamental mathematical principle in association with geometrical forming of the elliptic locus.

2. Description of the Related Art

Generally, with an ellipse means, as shown in FIG. 1, a closed loop of an elliptic locus is generated by continuous movement of a vertex c of a triangle abc around an origin O on an x and y coordinate plane in a state wherein a length of each of two focal distances ac and bc is changed and the total length of the two focal distances ac and bc is not changed when a base ab of the triangle abc is fixedly given in a direction of a major axis as a distance between two foci of the ellipse.

The ellipse has a major axis $2r_1$ and a minor axis $2r_2$. When considering distances from the origin 0 of the x and y coordinate plane, that is, a semi-major axis $r_1$ and a semi-minor axis $r_2$, the semi-major axis $r_1$ indicates a length when the focal distances ac and bc are aligned in line with the x axis together with the base ab of the triangle abc, and the semi-minor axis $r_2$ indicates a height of the triangle abc when the focal distances ac and bc of the triangle abc form equilaterals of an isosceles triangle abc.

Due to aforementioned geometry of the ellipse, it is impossible to draw an ellipse with compasses for simply drawing a circle. From this standpoint and to cope with the problem, a plurality of ellipsographs are disclosed in the art.

As an example, an ellipsograph which is described in Korean Utility Model Application No. 87-13242, includes a support bar for defining a semi-major axis of an ellipse. The support bar is fixed by means of a left and right moving section and a major axis-adjusting thread which serve to maintain an elliptic locus. Then, a length of the major axis-adjusting thread is adjusted to draw an ellipse having a desired size, with the length then fixed. Thereupon, in the left and right moving section, as a moving segment and writing means which is coupled to the moving segment are simultaneously moved, an elliptic circumference is drawn by the writing means.

Further, another ellipsograph which is described in Korean Utility Model Application No. 78-4761, includes parent compasses which are rotated around a bevel gear. A foot plate which is to be fixed on a plane of a drawing sheet, is threaded into the bevel gear. The ellipsograph further includes son compasses which are rotated around one end of the parent compasses by an angle which is two times that of the rotation angle of the parent compasses. In this state, if the parent compasses are rotated by 360°, a center shaft is rotated and bevel gears are meshed with each other to be operated in an interlocked manner. Accordingly, another bevel gear which does not define a major axis, is rotated, and by this, the son compasses are rotated by an angle of 720° in a direction which is opposite to the rotating direction of the parent compasses, whereby drawing of the ellipse is effected.

As described above, with an ellipse means, an elliptic locus is generated by continuous movement of a vertex of a triangle in a state wherein a length of each of two focal distances is changed and the total length of the two focal distances is not changed when a base of the triangle is fixedly given as a distance between two foci of the ellipse. As a tool for drawing an ellipse, a multitude of ellipsographs which use a gearing mechanism or the like, are disclosed in the art.

However, the ellipsograph using the gearing mechanism or the like has a problem in that its structure is complicated and manipulation thereof is cumbersome. Also, even in the case of an ellipsograph using an adjusting string, an upper elliptic circumference must be first drawn, and then, after the ellipsograph is returned to its original position, a lower elliptic circumference must be drawn, whereby drawability of the ellipse is deteriorated.

Moreover, if an ellipsograph is used for teaching a fundamental mathematical principle of an ellipse, for example, in the elementary geometry, it is difficult with the conventional ellipsograph to prove the fact that with an ellipse means an elliptic locus is generated by continuous movement of a vertex of a triangle in a state wherein a length of each of two focal distances is changed and the total length of the two focal distances is not changed when a base of the triangle is fixedly given as a distance between two foci of the ellipse.

SUMMARY OF THE INVENTION

Accordingly, the present invention has been made in an effort to solve the problems occurring in the related art, and an object of the present invention is to provide an ellipsograph which has a simple structure, allows an ellipse drawing procedure to be conveniently implemented, and enables an ellipse having a variety of sizes to be drawn.

In order to achieve the above object, according to one aspect of the present invention, a base member for defining one side, that is, a base of a triangle, is provided and fixed to a plane of a drawing sheet; a centering section and an ellipse drawing frame are installed at a middle of the base member; an ellipse deriving thread for determining the total length of three sides of the triangle which is used to draw the ellipse is prepared and supported by both ends of the base member and one end of the ellipse drawing frame thereby to form the triangle; and the ellipse is drawn by the ellipse drawing frame while the ellipse drawing frame is rotated and linearly reciprocated due to the fact that the ellipse drawing frame is pressed by the ellipse deriving thread against elastic force of elastic means and biased by the elastic means against tension of the ellipse deriving thread.

Also, since a length of the base member for determining a distance between two foci of the ellipse and a length of the ellipse deriving thread for determining the total length of the three sides of the triangle vary, a size of the ellipse can be optionally adjusted as a user desires.

By the features of the present invention, a user can draw the ellipse in a simple manner while confirming with the naked eye a fundamental principle of forming an elliptic locus.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
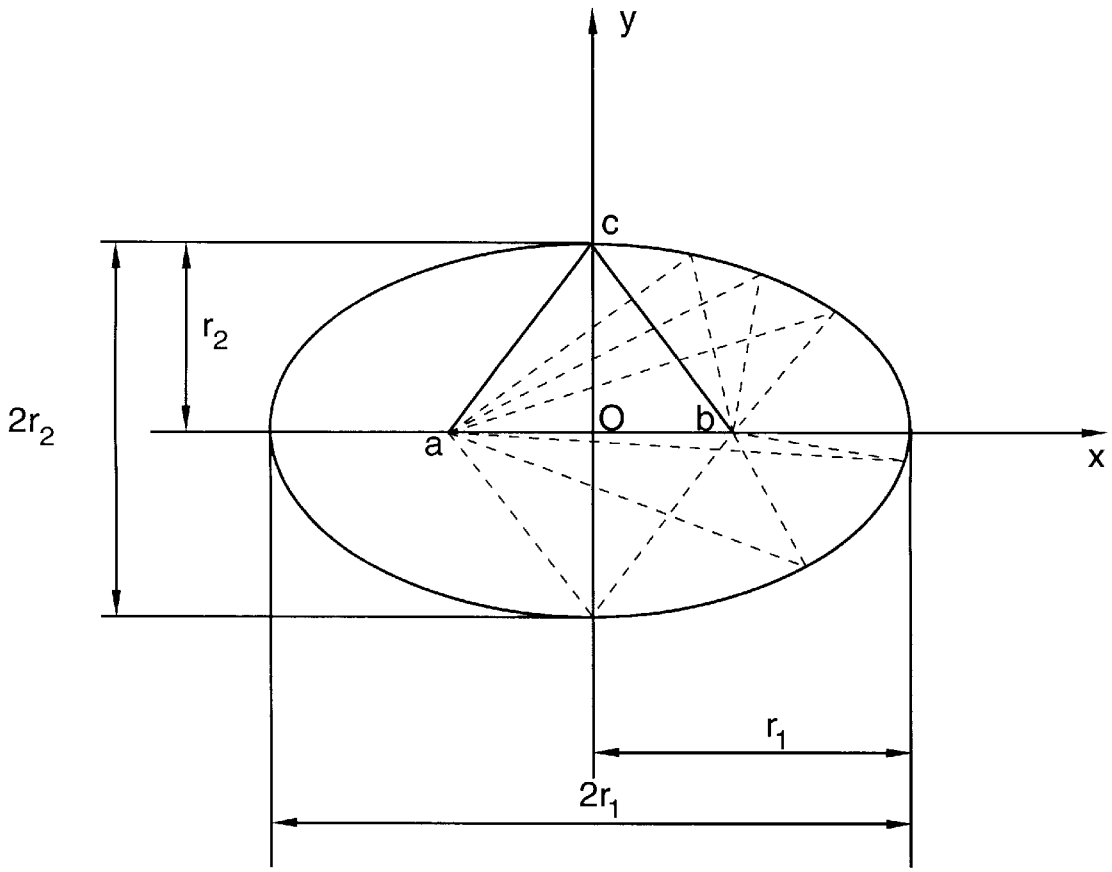
FIG. 1 is a coordinate chart illustrating a geometrical locus of an ellipse.

Reference will now be made in greater detail to a preferred embodiment of the invention, an example of which is illustrated in the accompanying drawings. Wherever possible, the same reference numerals will be used throughout the drawings and the description to refer to the same or like parts.

An ellipsograph in accordance with an embodiment of the present invention includes a base member 10, a centering section 12, an ellipse drawing frame 14 and an ellipse deriving thread 16. The base member 10 defines a distance between two foci of an ellipse. The ellipse drawing frame 14 is disposed above the base member 10 such that it can be rotated and linearly reciprocated. The centering section 12 is arranged at a lengthwise middle of the base member 10 and along a vertical direction for defining a center of the ellipse and holding the ellipse drawing frame 14 horizontal. The ellipse deriving thread 16 functions to determine a total length of three sides of a triangle which is used to draw the ellipse. One fixed side of the triangle is represented by the distance between the two foci of the ellipse. The ellipse deriving thread 16 is supported at three points by both ends of the base member 10 and one end of the ellipse drawing frame 14 thereby to form the triangle. By the aforementioned construction of the ellipsograph according to the present invention, the ellipse is drawn by the ellipse drawing frame 14 while the ellipse drawing frame 14 is rotated and linearly reciprocated.

The base member 10 comprises a left focus-defining lever 20 and a right focus-defining lever 22. One end of each of the left and right focus-defining levers 20 and 22 is inserted into a first guide tube 18 such that they can telescopically slide into and out of the first guide tube 18 to adjust the distance between the two foci of the ellipse. At this time, persons skilled in the art will appreciate that the two foci are represented by the other ends of the left and right focus-defining levers 20 and 22, respectively. Each of inner surfaces facing each other, of upright wall portions of the left and right focus-defining levers 20 and 22, is formed with a rack 24. A pinion 26 is coupled to the centering section 12 in the first guide tube 18 and at a lengthwise middle of the first guide tube 18 such that it is meshed with racks 24 of the left and right focus-defining levers 20 and 22. A pair of fixing pins 28 which define the distance between the two foci of the ellipse, are attached to the other ends of the left and right focus-defining levers 20 and 22, respectively. Also, a pair of guide rollers 30 are arranged above the pair of fixing pins 28, respectively, for enabling the ellipse deriving thread 16 to be easily moved thereon.

The centering section 12 includes a reference plate 32 for holding the ellipse drawing frame 14 horizontal. A centering pin 34 for defining the center of the ellipse is affixed to a lower surface of the reference plate 32. A spacer plate 36 onto which the first guide tube 18 is seated, is located on the reference plate 32. A center shaft 38 is erected on the reference plate 32 such that it can be freely rotated while being coaxially aligned with the centering pin 34. The pinion 26 for adjusting a length of the base member 10 which corresponds to the distance between the two foci of the ellipse and a first knob segment 40 for rotating the pinion 26, are mounted around a circumferential outer surface of the center shaft 38. A second guide tube 42 is installed at an upper end of the center shaft 38 while being horizontally maintained with respect to the reference plate 32, such that it can be freely rotated. The other end of the ellipse drawing frame 14 is inserted through the second guide tube 42 such that it can telescopically slide into and out of the second guide tube 42. Elastic means 43 is placed around the other end of the ellipse drawing frame 14 to allow the ellipse drawing frame 14 to maintain tension of the ellipse deriving thread 16. Writing means 44 is attached to the one end of the ellipse drawing frame 14. A winding roller 48 is disposed above the writing means 44 and about a shaft which is coaxial with an axis of the writing means 44, such that a length of the ellipse deriving thread 16 can be regulated. Both ends of the ellipse deriving thread 16 are fixed to a circumferential outer surface of the winding roller 48. A second knob segment 46 for rotating the winding roller 48 is installed on an upper end of the shaft. Clamping means 50 for controlling the rotation of the winding roller 48 is disposed on the winding roller 48.

Figure 2A:
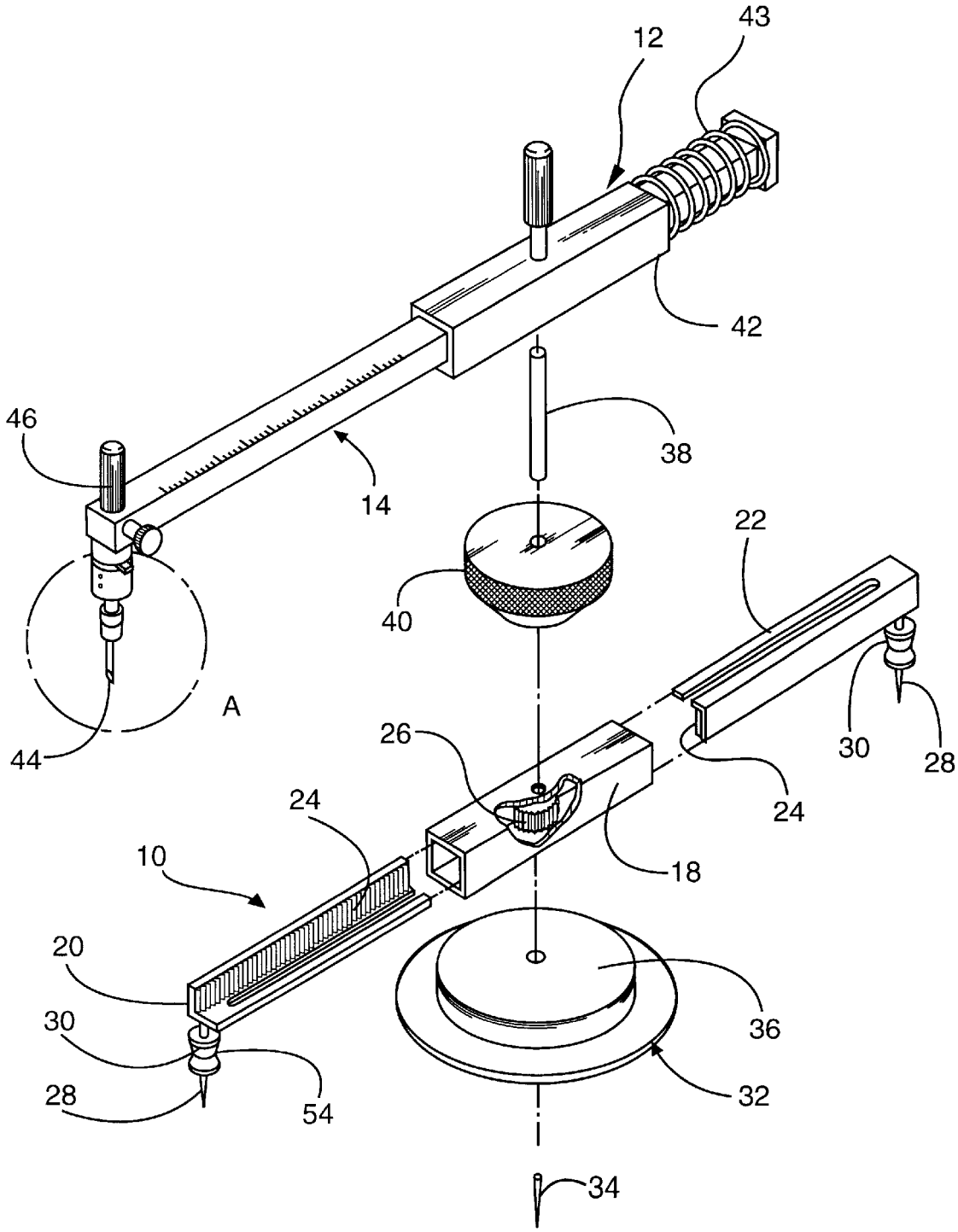
FIG. 2A is an exploded perspective view of an ellipsograph in accordance with an embodiment of the present invention.
Figure 2B:
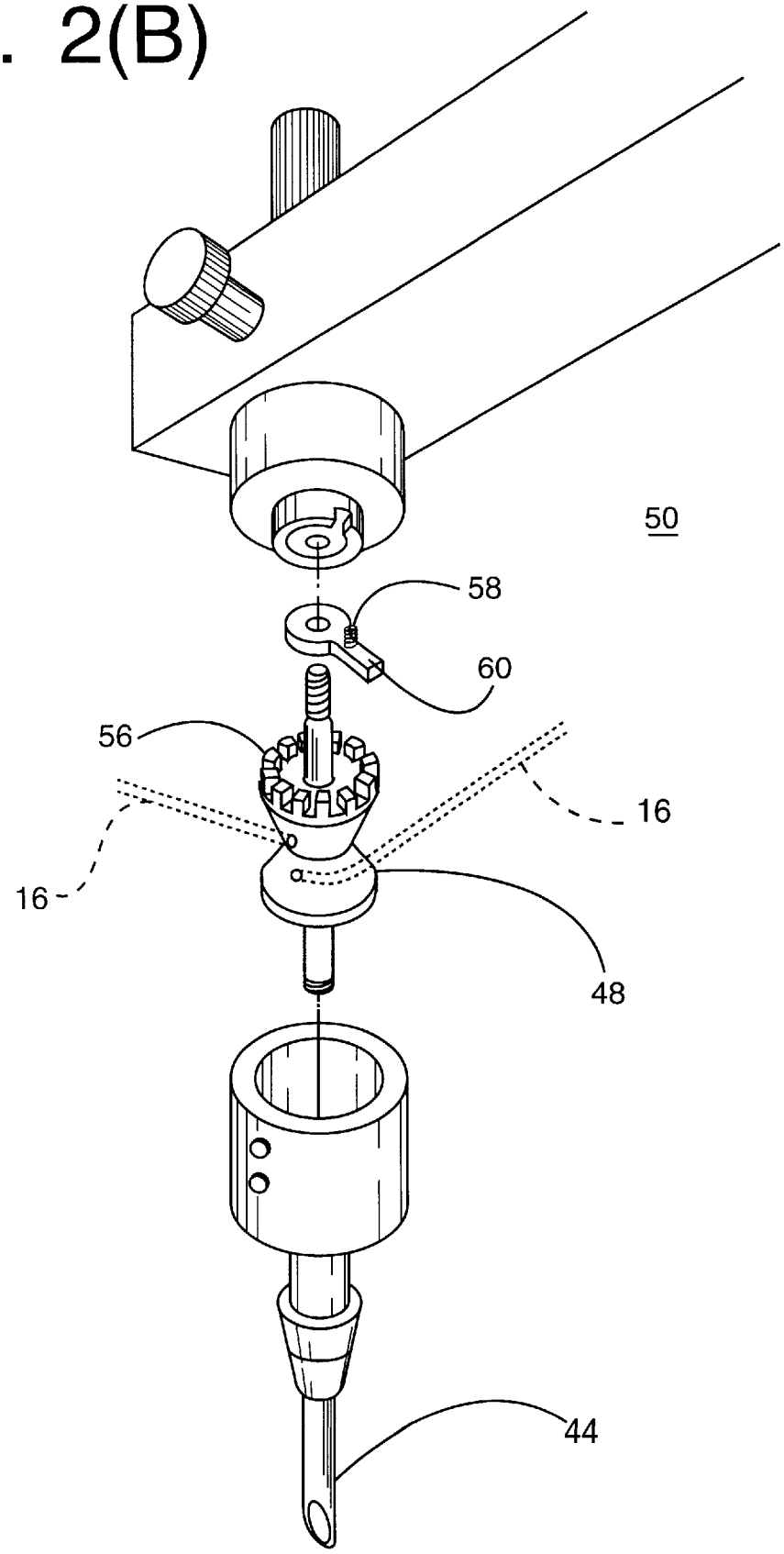
FIG. 2B is a partial enlarged and exploded perspective view for a circle A of FIG. 2A.
Figure 2C:
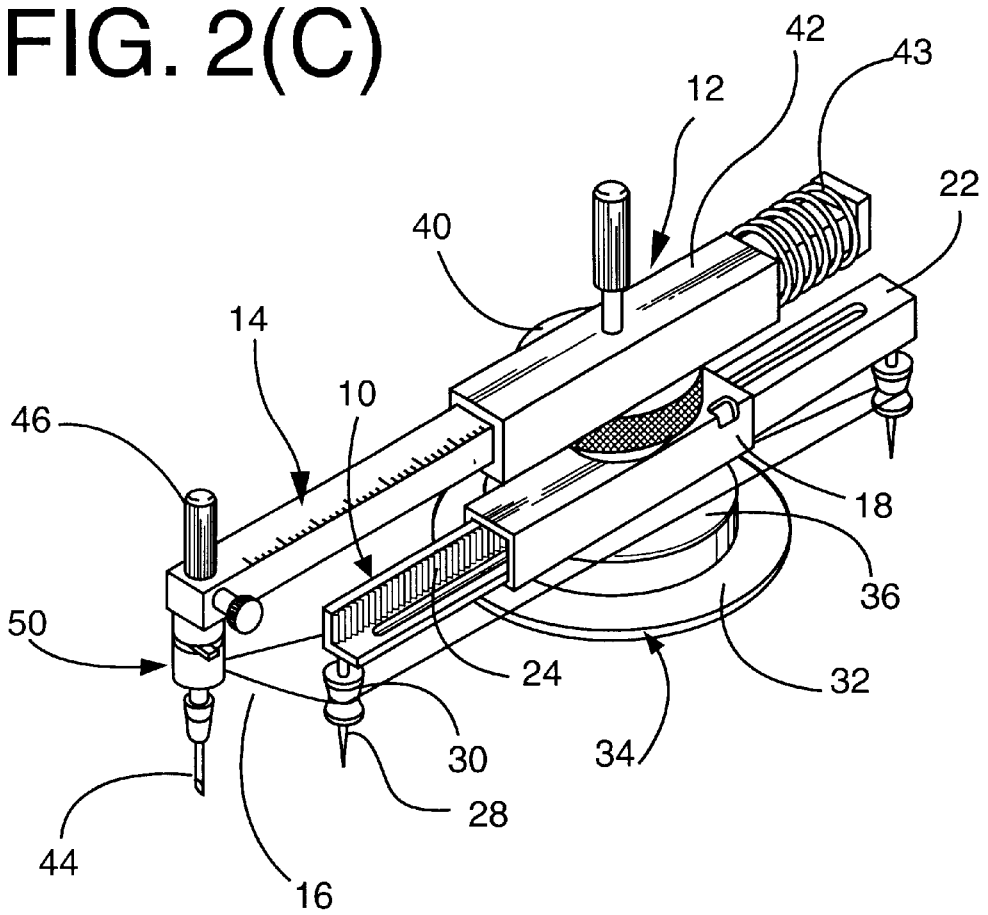
FIG. 2C is a perspective view illustrating a state wherein the ellipsograph according to the present invention is assembled.

FIG. 2A is an exploded perspective view of the ellipsograph in accordance with the embodiment of the present invention. FIG. 2B is a partial enlarged and exploded perspective view for a circle A of FIG. 2A. FIG. 2C is a perspective view illustrating a state wherein the ellipsograph according to the present invention is assembled. The present invention enables an elliptic locus to be drawn by the most fundamental mathematical principle.

In other words, a base of the triangle is fixed as the distance between the two foci of the ellipse. Thereupon, the ellipse is drawn as two focal distances which extend from the two foci of the ellipse, respectively, to a vertex of the triangle, which varies due to the movement of the vertex.

To this end, according to the present invention, the base member 10 for defining the one side, that is, the base of the triangle, is provided and fixed to a plane; the centering section 12 and the ellipse drawing frame 14 are installed at the middle of the base member 10; the ellipse deriving thread 16 for determining the total length of the three sides of the triangle which is used to draw the ellipse is prepared and supported by both ends of the base member 10 and one end of the ellipse drawing frame 14 thereby to form the triangle; and the ellipse is drawn by the ellipse drawing frame 14 while the ellipse drawing frame 14 is rotated and linearly reciprocated due to the fact that the ellipse drawing frame 14 is pressed by the ellipse deriving thread 16 against the elastic force of the elastic means 43 and biased by the elastic means 43 against the tension of the ellipse deriving thread 16.

The length of the base member 10 can be adjusted to enable the distance between the two foci of the ellipse to be determined bowing to a user's option. Because the length adjustment of the base member 10 is effected due to the fact that the left and right focus-defining members 20 and 22 are simultaneously extended from and retracted into the first guide tube 18 by the same amount, the likelihood for the center of the ellipse to be changed on the plane is eliminated.

To this end, the base member 10 is divided into the left focus-defining lever 20 and the right focus-defining lever 22 each of which is formed with the rack 24. The pinion 26 which is meshed with the racks 24 of the left and right focus-defining levers 20 and 22, is interference-fitted around the center shaft 38. The pair of racks 24 are meshed with the pinion 26 such that they are operated in an interlocked manner with the pinion 26.

Figure 3:
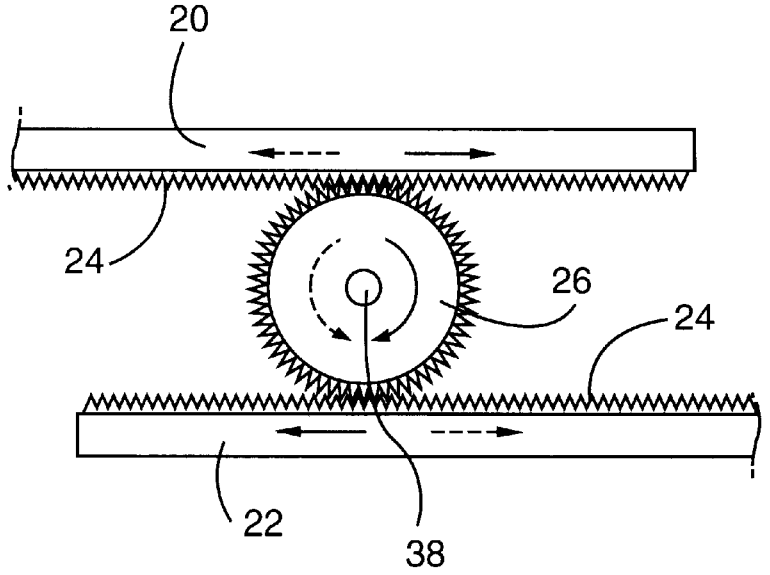
FIG. 3 is a cross-sectional view of a portion of FIG. 2C.

Accordingly, as shown in FIG. 3, as the pinion 26 is rotated, the left and right focus-defining levers 20 and 22 can be simultaneously extended out of and retraced into the first guide tube 18 by the same length. By this, the distance between the two foci of the ellipse can be optionally determined in accordance with a user's desire while the center of the ellipse is maintained as it is.

In the meanwhile, by forming a scale on one of the left and right focus-defining levers 20 and 22 and a sight glass on the first guide tube 18, two times a length which is measured through from the sight glass, equals to the distance between the two foci of the ellipse.

On the other hand, the pair of fixing pins 28 are attached to both ends of the base member 10, respectively, to fix the distance between the two foci of the ellipse on a plane, and the pair of guide rollers 30 are arranged above the pair of fixing pins 28, respectively, for facilitating the movement of the ellipse deriving thread 16 thereon.

Further, each of the pair of guide rollers 30 is formed with a circumferential groove 54 which serves to hold the position of the ellipse deriving thread 16 on the guide roller 30 constant.

The centering section 12 which is arranged at the lengthwise middle of the base member 10 and along the vertical direction for defining the center of the ellipse and holding the ellipse drawing frame 14 horizontal, has the reference plate 32, centering pin 34, center shaft 38, pinion 26, the first knob segment 40, second guide tube 42, etc.

The reference plate 32 provides a reference surface which is brought into close contact with the plane of a drawing sheet. The center shaft 38 extends in a direction which is orthogonal to the reference plate 32, and the second guide tube 42 is perpendicularly arranged on the upper end of the center shaft 38. Therefore, the movement of the ellipse drawing frame 14 which is inserted into the second guide tube 42 such that it can be reciprocated in the second guide tube 42 and is integrally rotated together with the second guide tube 42, is realized in a state wherein the ellipse drawing frame 12 is maintained parallel to the plane of the drawing sheet.

The centering pin 34 is affixed to the lower surface of the reference plate 32 in a point which corresponds to the center of the ellipse, thereby to allow the center of the ellipse to be easily fixed on the plane of the drawing sheet. A lower end of the center shaft 38 is erected on the reference plate 32 such that it can be freely rotated while being coaxially aligned with the centering pin 34. The spacer plate 36 is located on the reference plate 32 such that is maintained in the same height along with the pair of fixing pins 28.

The upper end of the center shaft 38 is connected to the second guide tube 42 such that it can be freely rotated, thereby to prevent the entire centering section 12 from being rotated due to the rotation of the second guide tube 42.

In addition, the pinion 26 and the first knob segment 40 for rotating the pinion 26 are mounted around the circumferential outer surface of the center shaft 38. Hence, by gripping and rotating the first knob segment 40, the pinion 26 which is coaxially positioned with the first knob segment 40, is rotated as well, whereby the left and right focus-defining levers 20 and 22 which constitute the base member 10 are moved into and out of the first guide tube 18.

On the other hand, the ellipse drawing frame 14 is slidably fitted into the second guide tube 42 of the centering section 12. Due to the fact that the one end of the ellipse drawing frame 14 cooperates with both ends of the base member 10 to define the shape of the triangle, the ellipse can be drawn thanks to the tensioning of the ellipse deriving thread 16. At this time, as in the case of the base member 10, another scale may be formed on the ellipse drawing frame 14, and another sight glass may be formed on the second guide tube 42. Thereupon, when the base member 10 and the ellipse drawing frame 14 are held horizontal with each other, a length which is measured from the plane of the drawing sheet to a center of the ellipse drawing frame 14 denotes a semi-minor axis.

Furthermore, the elastic means 43 is placed around the other end of the ellipse drawing frame 14 to allow the ellipse drawing frame 14 to maintain tension of the ellipse deriving thread 16, thereby holding the shape of the triangle.

The elastic means 43 which comprises, for example, a spring, etc., applies elastic force to the ellipse deriving thread 16 outside of the elliptic locus, thereby maintaining the tension of the ellipse deriving thread 16.

At this time, the length of the ellipse deriving thread 16 which corresponds to the total length of the three sides of the triangle, can be varied.

To this end, as can be best seen from FIG. 2B, the winding roller 48 is disposed above the writing means 44 which is attached to the one end of the ellipse drawing frame 14 to draw the ellipse and about the shaft which is coaxial with the axis of the writing means 44. Both ends of the ellipse deriving thread 16 are fixed to the circumferential outer surface of the winding roller 48. Accordingly, if the second knob segment 46 (see FIG. 2A) is rotated, the ellipse deriving thread 16 can be wound around or unwound from the winding roller 48, thereby to effect the length adjustment for the ellipse deriving thread 16.

On the other hand, once the length adjustment operation for the ellipse deriving thread 16 is completed, it is preferred that the clamping means 50 for keeping the length of the ellipse deriving thread 16 from being changed, is provided. The clamping means 50 comprises a plurality of toothed portions 56, a spring 58 and an engaging piece 60. The plurality of toothed portions 56 are formed on an upper end of the winding roller 48 such that they are spaced apart one from another. Therefore, due to the fact that the spring 58 biases the engaging piece 60 so that it is engaged into a groove which is defined between two adjoining toothed portions 56, the rotation of the winding roller 48 can be effectively prevented.

Figure 4:
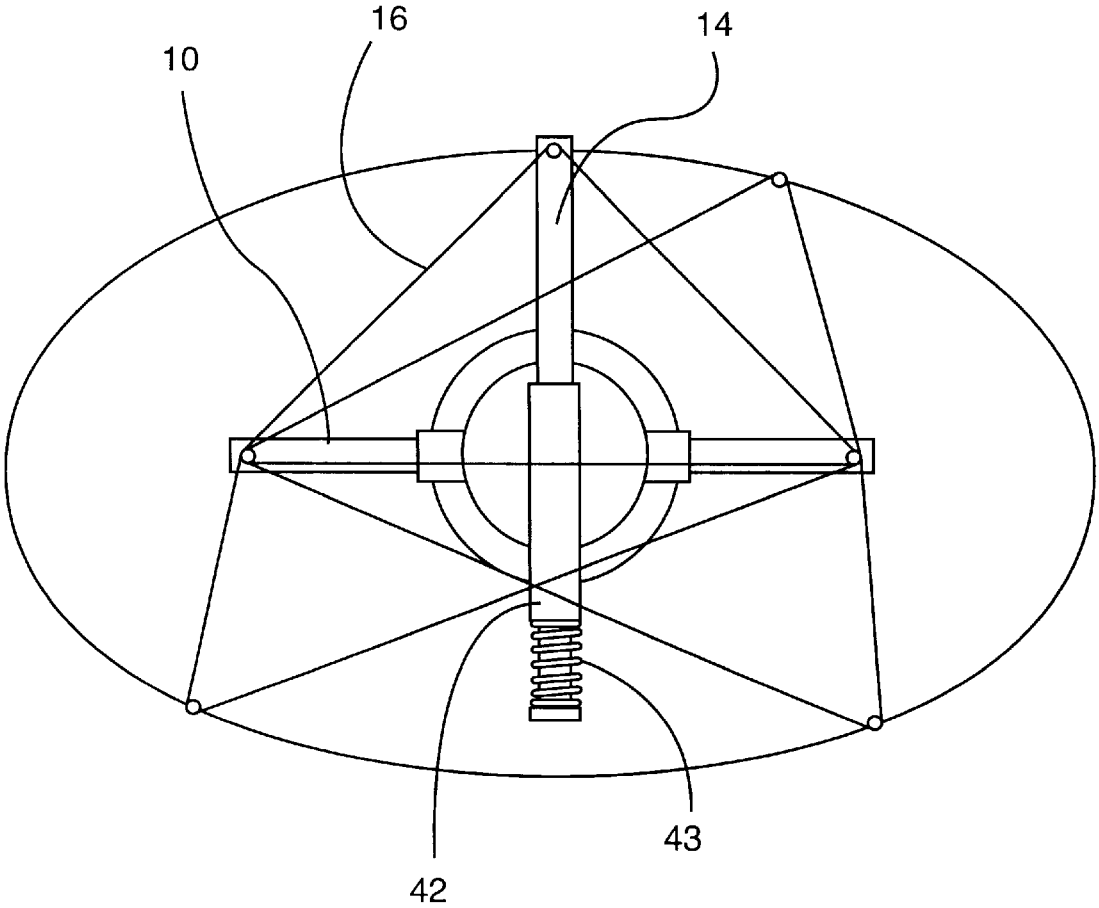
FIG. 4 is a view for explaining a procedure for drawing an ellipse using the ellipsograph according to the present invention.

Hereinafter, a procedure for drawing an ellipse using the ellipsograph according to the present invention, constructed as mentioned above, will be described with reference to FIG. 4.

First, in the case that an ellipse a size of which is of little importance is to be drawn, a length of the base member 10 which represents a length of a base of a triangle is optionally determined. Then, the length of the base member 10 is fixed onto a plane of a drawing sheet by means of the centering pin 34 and the pair of fixing pins 28. Thereafter, by applying appropriate tension to the ellipse deriving thread 16 by the ellipse drawing frame 14 which is biased by the elastic means 43, the ellipse deriving thread 16 defines a shape of a triangle. Next, by grasping and then rotating the second knob segment 46 in one direction, each of two focal distances which extend from two foci of the ellipse, that is, both ends of the base member 10, to a vertex of the triangle, varies while the total length of the two focal distances is not changed, whereby the ellipse is drawn by the writing means 44 which is attached to the one end of the ellipse drawing frame 14.

At this time, the ellipse drawing frame 14 is reciprocatingly moved in the second guide tube 42, and at the same time, the ellipse is drawn in a state wherein tension of the ellipse deriving thread 16 is maintained by the elastic means 43.

On the other hand, in the case that an ellipse a size of which has importance is to be drawn, lengths of a major axis and a semi-minor axis are determined by calculation. Then, a length of the base member 10 is adjusted to correspond to a distance between two foci of the ellipse to be drawn and then fixed to a plane of a drawing sheet. Thereafter, both ends of the ellipse deriving thread 16 having a predetermined length is fixed to winding roller 48 of the ellipse drawing frame 14, and then, the winding roller 48 is rotated to define a shape of a triangle. Thereupon, by rotating the second knob segment 46 as described above, the ellipse is drawn by the writing means 44 of the ellipse drawing frame 14.

As described above, according to the present invention, a base member for defining one side, that is, a base of a triangle, is provided and fixed to a plane of a drawing sheet; a centering section and an ellipse drawing frame are installed at a middle of the base member; an ellipse deriving thread for determining the total length of three sides of the triangle which is used to draw the ellipse is prepared and supported by both ends of the base member and one end of the ellipse drawing frame thereby to form the triangle; and the ellipse is drawn by the ellipse drawing frame while the ellipse drawing frame is rotated and linearly reciprocated due to the fact that the ellipse drawing frame is pressed by the ellipse deriving thread against elastic force of elastic means and biased by the elastic means against tension of the ellipse deriving thread.

Also, since a length of the base member for determining a distance between two foci of the ellipse and a length of the ellipse deriving thread for determining the total length of the three sides of the triangle vary, a size of the ellipse can be optionally adjusted as a user desires.

Consequently, by the present invention, because the user can draw the ellipse in a simple manner in accordance with a fundamental principle in association with the forming of an elliptic locus, convenience is improved upon drafting an industrial design. Furthermore, in the case that the ellipsograph according to the present invention is manufactured to have a macro dimension, a large ellipse and a streamlined pattern can be easily drafted upon implementing interior decoration. Moreover, since the ellipsograph of the present invention has a simple structure, an ellipse drawing procedure can be confirmed by the naked eye, whereby educational effectiveness of the ellipsograph is enhanced.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An ellipsograph comprising:

a base member for defining a distance between two foci of an ellipse;

an ellipse drawing frame disposed above the base member such that it can be rotated and linearly reciprocated;

a centering section arranged at a lengthwise middle of the base member and along a vertical direction for defining a center of the ellipse and for holding the ellipse drawing frame horizontal;

an ellipse deriving thread for determining a total length of three sides of a triangle which is used to draw the ellipse, with one fixed side thereof represented by the distance between the two foci of the ellipse, the ellipse deriving thread being supported by opposite ends of the base member and one end of the ellipse drawing frame thereby to form the triangle, the ellipse being drawn by the ellipse drawing frame while the ellipse drawing frame is rotated and linearly reciprocated; and the base member including:

a guide, a left focus-defining lever, one end of which is linearly movable with respect to the guide, a right focus-defining lever, one end of which is linearly movable with respect to the guide, such that the left and right focus-defining levers can linearly slide relative to the guide to adjust the distance between the two foci of the ellipse, which are represented by opposite ends of the left and right focus-defining levers, a rack formed on each of inner surfaces of the left and right focus-defining levers, a pinion coupled to the centering section at the guide and at a lengthwise middle of the guide such that the pinion meshes with the racks of the left and right focus-defining levers, and a pair of fixing pins which define the distance between the two foci of the ellipse, attached to said opposite ends of the left and right focus-defining levers, respectively.

2. An ellipsograph according to claim 1, wherein said base member further includes a pair of guide rollers arranged above the pair of fixing pins, respectively, for enabling the ellipse deriving thread to be easily moved thereon.

3. An ellipsograph according to claim 1, wherein said guide includes a guide tube, and said one end of each of said left focus-defining lever and right focus-defining lever, are inserted into the guide tube, such that the left and right focus-defining levers can telescopically slide into and out of the guide tube to adjust the distance between the two foci of the ellipse.

4. An ellipsograph according to claim 3, wherein said pinion is coupled to the centering section in the guide tube and at a lengthwise middle of the guide tube.

5. An ellipsograph according to claim 1, wherein said inner surfaces of the left and right focus-defining levers are formed on upright wall portions of the left and right focus-defining levers.

6. An ellisograph according to claim 1, wherein the centering section includes:

a reference plate for holding the ellipse drawing frame horizontal, a centering pin for defining the center of the ellipse, affixed to a lower surface of the reference plate, and a center shaft erected on the reference plate such that the center shaft can be freely rotated while being coaxially aligned with the centering pin.

7. An ellipsograph as claimed in claim 6, wherein the pinion is mounted around a circumferential outer surface of the center shaft.

8. An ellipsograph as claimed in claim 6, further including a first knob segment for rotating the pinion, the first knob segment mounted around a circumferential outer surface of the center shaft.

9. An ellipsograph as claimed in claim 6, wherein said centering section further includes a spacer plate onto which the guide is seated, said spacer plate being located on the reference plate.

10. An ellipsograph as claimed in claim 6, further comprising a second guide installed at an upper end of the center shaft while being horizontally maintained with respect to the reference plate, such that the second guide can be freely rotated;

wherein an opposite end of the ellipse drawing frame is slidable relative to the second guide;

further comprising an elastic device placed around said opposite end of the ellipse drawing frame to allow the ellipse drawing frame to maintain tension of the ellipse deriving thread; and further comprising a writing device attached to said one end of the ellipse drawing frame.

11. An ellipsograph as claimed in claim 10, wherein said second guide includes a guide tube, and said opposite end of the ellipse drawing frame is inserted through the second guide tube such that the second guide tube can telescopically slide into and out of the second guide tube.

12. An ellipsograph as claimed in claim 10, further comprising:

a winding roller disposed above the writing device and about a shaft which is coaxial with an axis of the writing device, such that a length of the ellipse deriving thread can be regulated, with opposite ends of the ellipse deriving thread being fixed to a circumferential outer surface of the winding roller;

a knob segment for rotating the winding roller, installed on an upper end of the shaft which is coaxial with the axis of the writing device; and a clamping device for controlling the rotation of the winding roller, disposed on the winding roller.

13. An ellipsograph comprising:

a base member for defining a distance between two foci of an ellipse;

an ellipse drawing frame disposed above the base member such that it can be rotated and linearly reciprocated;

a centering section arranged at a lengthwise middle of the base member and along a vertical direction for defining a center of the ellipse and holding the ellipse drawing frame horizontal, the centering section including:

a reference plate for holding the ellipse drawing frame horizontal, and a centering pin for defining the center of the ellipse, affixed to a lower surface of the reference plate, and a center shaft erected on the reference plate such that the center shaft can be freely rotated while being coaxially aligned with the centering pin;

an ellipse deriving thread for determining a total length of three sides of a triangle which is used to draw the ellipse, with one fixed side thereof represented by the distance between the two foci of the ellipse, the ellipse deriving thread being supported by both ends of the base member and one end of the ellipse drawing frame thereby to form the triangle, the ellipse being drawn by the ellipse drawing frame while the ellipse drawing frame is rotated and linearly reciprocated.

14. An ellipsograph as claimed in claim 13, wherein said centering section further includes a spacer plate onto which the base section is seated, said spacer plate being located on the reference plate.

15. An ellipsograph as claimed in claim 13, further comprising a guide installed at an upper end of the center shaft while being horizontally maintained with respect to the reference plate, such that the guide can be freely rotated;

wherein an opposite end of the ellipse drawing frame is slidable relative to the guide;

further comprising an elastic device placed around said opposite end of the ellipse drawing frame to allow the ellipse drawing frame to maintain tension of the ellipse deriving thread; and further comprising a writing device attached to said one end of the ellipse drawing frame.

16. An ellipsograph as claimed in claim 15, wherein said guide includes a guide tube, and said opposite end of the ellipse drawing frame is inserted through the guide tube such that the second guide tube can telescopically slide into and out of the guide tube.

17. An ellipsograph as claimed in claim 13, further comprising:

a winding roller disposed above the writing device and about a shaft which is coaxial with an axis of the writing device, such that a length of the ellipse deriving thread can be regulated, with opposite ends of the ellipse deriving thread being fixed to a circumferential outer surface of the winding roller;

a knob segment for rotating the winding roller, installed on an upper end of the shaft which is coaxial with the axis of the writing device; and a clamping device for controlling the rotation of the winding roller, disposed on the winding roller.

* * * * *